US005228204A

United States Patent [19]

Khoshnood

[11] Patent Number: 5,228,204

[45] Date of Patent: Jul. 20, 1993

[54] ARCHERY BOW SIGHT HAVING INDIVIDUALLY ADJUSTABLE SIGHT PINS

[76] Inventor: Bahram Khoshnood, 8104-B Thames Blvd., Boca Raton, Fla. 33433

[21] Appl. No.: 951,818

[22] Filed: Sep. 28, 1992

[51] Int. Cl.[5] ..... F41G 1/467

[52] U.S. Cl. ..... 33/265; 124/87

[58] Field of Search ..... 33/265, 254, 261; 124/87

[56] References Cited

U.S. PATENT DOCUMENTS

| | | | |
|---|---|---|---|
| 3,696,517 | 10/1972 | Larson | 33/265 |
| 3,822,479 | 7/1974 | Kowalski | 33/265 |
| 4,020,560 | 5/1977 | Heck | 33/265 |
| 4,535,747 | 8/1985 | Kudiacak . | |
| 4,625,421 | 12/1986 | Strauss | 33/265 |
| 4,715,126 | 12/1987 | Holt | 33/265 |
| 4,823,474 | 4/1989 | Reynolds | 33/265 |
| 4,928,394 | 5/1990 | Sherman . | |
| 4,953,302 | 9/1990 | Gould . | |
| 5,050,576 | 9/1991 | Larson . | |
| 5,086,567 | 2/1992 | Tutsch . | |

OTHER PUBLICATIONS

"Cobra Accessories for Every Bowhunter" Catalog, Cobra Mfg. Co., Inc. Oct. 1987 pp. 1-2.

*Primary Examiner*—William A. Cuchlinski, Jr.
*Assistant Examiner*—Alvin Wirthlin
*Attorney, Agent, or Firm*—Robert S. Babayi

[57] ABSTRACT

A bow sight includes a plurality of individually adjustable sight pins capable of longitudinally moving along a bow sight track. Each sight pin is extended form a sight pin carrier which includes a user activatable locking means. Upon activation, the sight pin carriers are locked to the track preventing movement of the sight pin carrier. A rotatable threaded shaft is positioned within the track, which upon rotation by a knob moves an unlocked one of the sight pin carriers along the track. Therefore, an archer may individually adjust a desired sight pin by unlocking its sight pin carrier and rotating the knob.

16 Claims, 2 Drawing Sheets

ARCHERY BOW SIGHT HAVING INDIVIDUALLY ADJUSTABLE SIGHT PINS

BACKGROUND OF THE INVENTION

This invention generally relates to the field of archery bow sights and more particularly to bow sights having a plurality of adjustable sight pins.

Bow sights with a plurality of sight pins are extensively used in hunting and tournaments to facilitate aiming at targets positioned at various distances. Each sight pin corresponds to a particular target distance. At times, the position of sight pins must be longitudinally adjusted by an archer to accommodate a change in targeting condition, such as when the arrow weight and length or when the target distance changes. As the targeting conditions change more frequently, archers may spend a long time for adjusting and tuning the sight for tournament or bow hunting. Because frequent adjustment of each pin may be tedious and time consuming, there have been a number of prior art approaches to simplify this process.

Some conventional bow sights with multiple sight pins use a ganged adjustment mechanism whereby all the sight pins are moved simultaneously to effectuate a desired adjustment. In one such arrangement a multiple sight pin block is moved along the length of a threaded shaft, when the shaft is rotated in clock wise or counter clock wise direction. However, most of the time the targeting conditions are such that the archer desires to adjust the position of only a selected one of the sight pins without changing the position of the others. This is because the other sight pins may already be properly positioned for their corresponding target conditions.

A prior art approach for individually adjusting a single sight pin without effecting others is disclosed in a U.S. patent issued to Kudiacak (U.S. Pat. No.4,535,747). Kudiacak's approach provides a plurality of individually slidable sight pin carriers each of which include a clamping thumb screw. The pin carriers may be slided along a track defined by two parallel longitudinal slots disposed on a mounting block where each sight pin carrier may be locked to a fixed position by tightening its thumb screw which locks the pin carrier to the mounting block.

Another prior art approach for individually adjusting the sight pins is disclosed in U.S. Pat. No. 4,715,126 issued to Holt. Holt discloses a bow sight in which each sight pin carrier includes a thumb wheel which upon rotation moves the carrier along a path defined by a fixed and non-rotatable threaded shaft.

Therefore, there is a need for a bow sight which allows individual adjustment of the sight pins while overcoming deficiencies encountered in the prior art approaches.

SUMMARY OF THE INVENTION

It is an object of the present invention to provide a bow sight having a plurality of individually adjustable sight pins.

It is another object of the present invention to adjust only a selected one of the sight pins without effecting position of others.

It is yet another object of the present invention to individually adjust sight pins by rotating a single knob.

Briefly, according to the present invention, a sight for an archery bow includes a plurality of elongated sight pins which are extended from corresponding sight pin carries. The sight pin carriers are mounted on a base plate having a track and a longitudinally positioned threaded shaft which define a predefined path along which the pin carriers may move. The pin carriers are moved along the path by rotating the threaded shaft via a single knob. Each sight pin carrier includes a user activatable locking means which prevents the movement of the sight pin carrier along the path. The locking means comprises a clamping means which at user's election clamps a selected one of the sight pin carriers to the track in order to prevent movement of the sight pin even when the threaded shaft is rotated. In this way, an individual one of the plurality of sight pins may be independently adjusted without effecting the position of others.

DESCRIPTION OF THE PREFERRED EMBODIMENT

Figure 1:
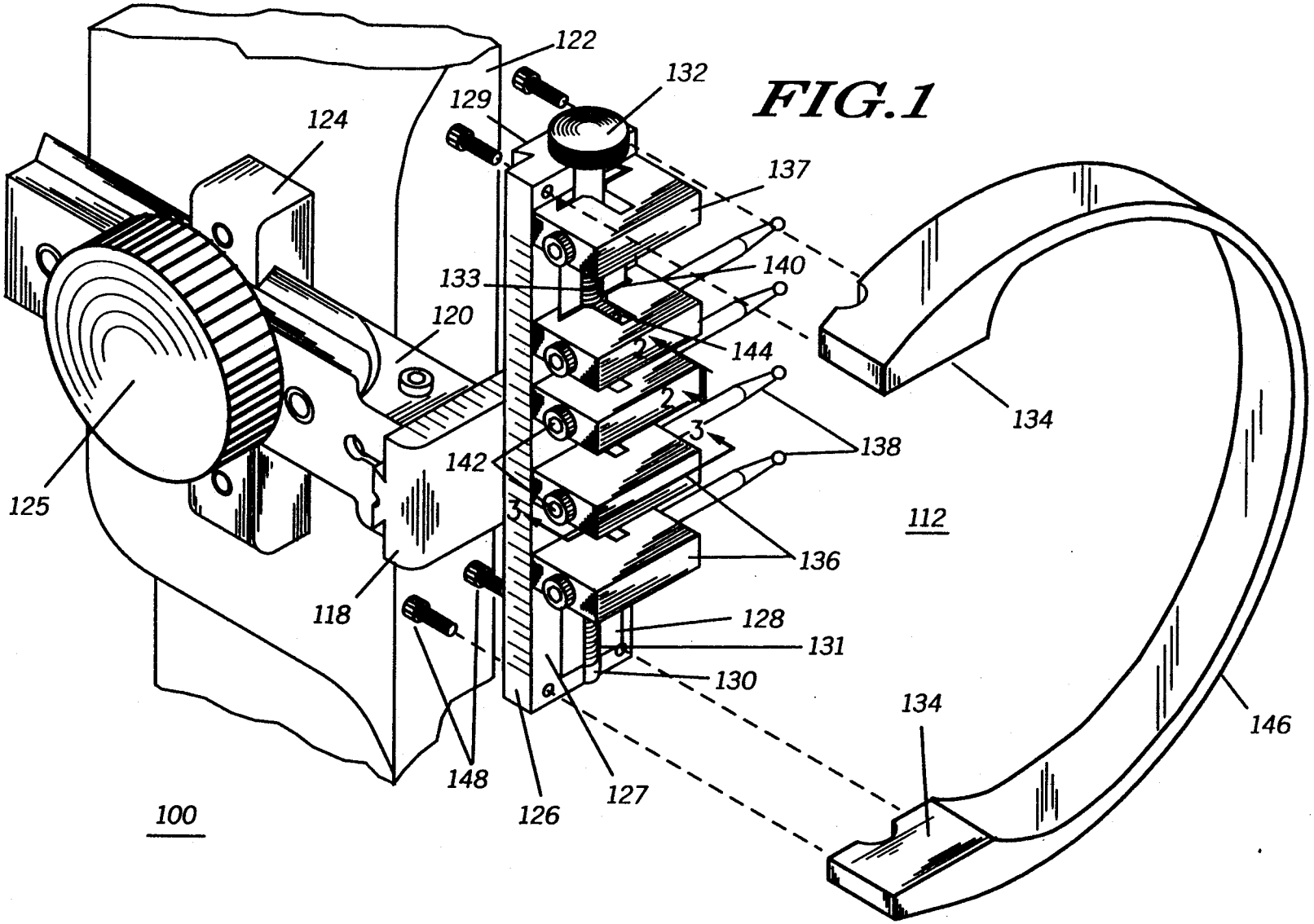
FIG. 1 is an isometric view of a bow sight having individually adjustable sight pins.

Referring to FIG. 1, a bow sight 100 includes a sight block 112 embodying the features of the present invention. The sight block 112 is horizontally extended by an extension arm 118 which provides the windage setting for the bow sight 100. The extension arm is attached to a mounting arm 120 in a manner which anchors the bow sight 100 to a suitable position on a bow handle 122 by means of a mounting block 124. The mounting arm 120 is slidably engaged to the mounting block 124 and may be fixed at a desired position by tightening a knob screw 125.

The sight block 112 includes a mounting base plate 126 which has formed on its front surface 127 a raised portion defining a centrally positioned longitudinal dove tail track 128. A dove tail track 129 is formed on the opposing back surface of the base plate 126 which slidably engages to a correspondingly cross sectioned slot on the extension arm 118 for simultaneous yardage adjustment of the bow sight 100. A centrally positioned groove 133 is formed along the length of the dove tail track 128 for positioning therewithin a rotatable threaded shaft 131 of a lead screw 130. Preferably, the mounting base plate 126 comprises a cast or machined piece having integrally formed thereon the dove tail tracks 128 and 129 and the groove 133. The lead screw 130 includes a knob 132 for rotating the threaded shaft 131 in either a clockwise or a counter clockwise direction.

A plurality of elongated sight pins 138 are outwardly extended from a plurality of pin carriers 136. The pin carriers 136 are mounted on the base plate 126 by sliding their correspondingly shaped dove tail grooves 140 on to dove tail track 128, as illustrated. Each pin carrier 136 includes an engagement means comprising a gear 144 which is appropriately positioned with its teeth engaging the threaded shaft 131. Therefore, a movement means is provided for longitudinally moving the pin carriers 136 and the sight pins 138 along a straight path defined by the track 128 by rotating the threaded shaft 131.

As illustrated, the mounting base plate 126 also supports an arch-shaped protective bracket 146 which attaches via two pairs of set screws 148. The arch-shaped protective bracket 146 has a half-circular shape to prevent external forces from damaging the elongated sight pins 138. A block 137 is fixed to the edge of the dove tail track 128 for fixedly positioning the lead screw 130 while permitting rotation of the threaded shaft 131 by the knob 132. A pair of support portions 134 are formed at the opposing ends of the arch-shaped bracket 146 further supporting the lead screw 130.

Figure 2:
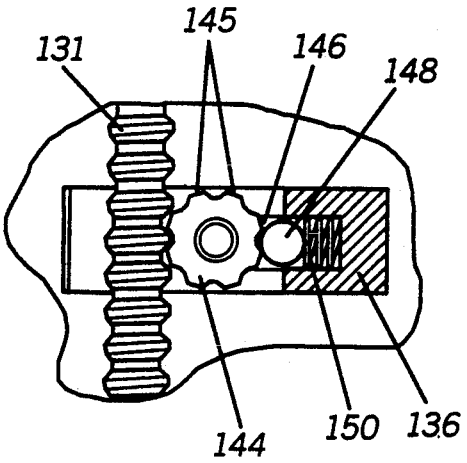
FIG. 2 is a fragmentary cross sectional view of a portion of the bow sight taken along a line 2—2 in FIG. 1.

Referring to FIG. 2, a fragmentary cross sectional view of portion of the bow sight 100 taken along a line 2—2 of FIG. 1 is shown, illustrating the above described engagement means of each pin carrier 136. The engagement means includes a spring loaded ball bearing comprising a ball bearing 148 and a spring 150 both of which are positioned within a cavity 146 formed inside each pin carrier 136, as illustrated. The spring loaded ball bearing bears against a plurality of teeth 145, thereby exerting a holding force on the gear 144. The force so exerted engages the gear 144 to the threaded shaft 131 such that when the shaft is rotated, the pin carrier 136 moves along the predefined path provided that the pin carrier 136 is not locked or inhibited from movement by restraining or locking opposing forces. If, however, the pin carrier block 136 is restrained or locked by overcoming external forces, the rotation of threaded shaft 131 exerts a force on the gear 144 forcing the spring loaded ball bearing configuration to compress in order to accommodate such rotation. As a result the pin carrier is maintained in a fixed stationary position.

Referring back to FIG. 1, when the knob 132 is rotated the resulting rotation of the threaded shaft 131 slidably moves any one of the unlocked and unrestrained pin carriers 136 along the path defined by the dove tail track 128 and the threaded shaft 131. According to the invention, each pin carrier 136 includes a user activatable locking means which upon activation prevents movements of a locked one of the pin carriers 136 even when the threaded shaft 131 is rotated. As such, an adjustable sight pin configuration is provided which allows the archer to individually adjust only a desired sight pin in either an upwardly or downwardly direction while maintaining the remaining ones of sight pins 138 in stationary positions. The archer may individually adjust the desired sight pin 138 by unlocking the corresponding sight pin carrier 136 to permit longitudinal movements along the track 128. As described later in detail, the archer may activate the locking means by tightening or loosening a clamping screw 142 positioned on each sight pin carrier 136.

Figure 3:
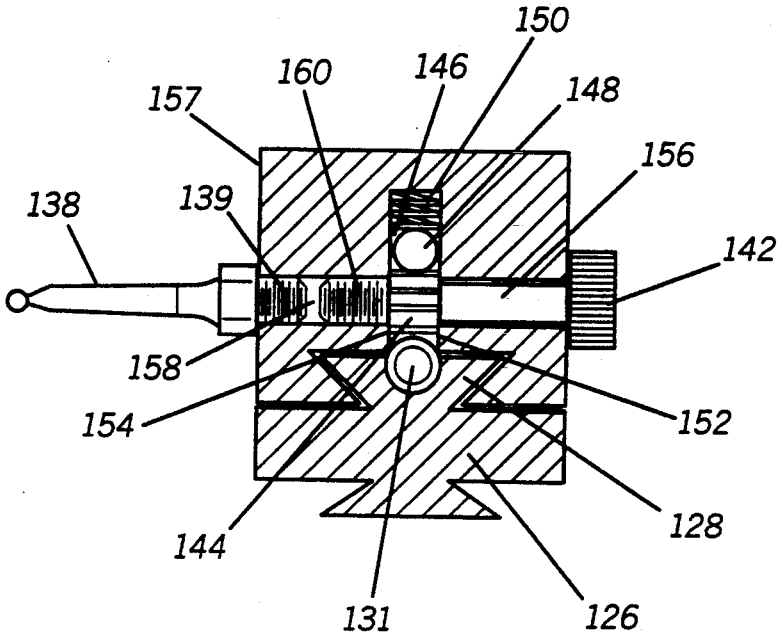
FIG. 3 is the cross sectional view of another portion of the bow sight taken along the line 3—3 of FIG. 1.

Referring to FIG. 3, the cross sectional view of a portion of the bow sight 100 taken along line 3—3 is shown, illustrating the above described locking means. As best illustrated, the clamping screw 142 extends partially through the cross section of the pin carrier 136. The sight pin carrier 136 includes a pair of supporting walls 152 and 154 positioned opposite each other such that the cavity 146 which houses the spring loaded ball bearing configuration is positioned between the walls 152 and 154. The cavity 146 as positioned provides certain resiliency, whereby upon exertion of a compressing force the walls 152 and 154 come closer to each other and upon removal of such force the walls 152 and 154 return to their original position. The sight pin carriers 136 are of course made of suitable material to withstand exertion of the compressing force.

According to the preferred embodiment of the invention, such compression forces is produced by tightening the clamping screw 142. Thus, a first bored hole 156 is extended through the entire width of the first wall 152 for inserting the clamping screw 142 thereacross. The gear 144 includes a concentric hole which allows the clamping screw 142 to cross through the cavity 146 and get screwed to a tapped hole 158 disposed on the wall 154. Preferably, the tapped hole 158 is extended across the entire width of the wall 154. In this arrangement, a threaded end 139 of the sight pin 138 gets screwed into the tapped hole 158 form an external surface 157 of the pin carrier 136. The length of the clamping screw 142 is selected such that once fully screwed its threaded shaft 160 only partially fills the tapped hole 158. Therefore, when the clamping screw 142 is sufficiently tightened, a clamping force, i.e. compression force, is produced between the supporting walls 152 and 154 bringing them closer to each other to clamp the dove tail track 128. The locking frictional force produced by the clamping overcomes any opposing force produced by engaging the gear 144 and rotating threaded shaft 131. Once clamped, the spring loaded ball bearing moves back and forth to accommodate for the rotation of the threaded shaft 131 and the gear 144. Therefore, each sight pin carrier is locked and prevented from moving by sufficiently tightening the clamping screw 142 even when the threaded shaft is rotated. Once the clamping screw 142 is loosened the axial clamping force is removed and the sight pin carrier 136 may move along the track 128 unhindered once the threaded shaft 131 is rotated.

Figure 4:
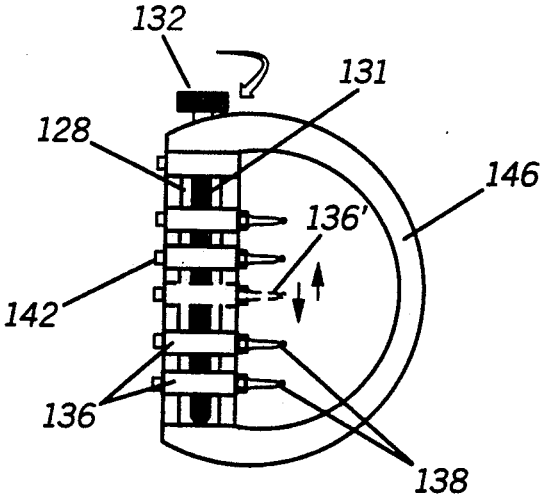
FIG. 4 is the front elevational view of the bow sight of FIG. 1.

Referring to FIG. 4, the front elevational view of the bow sight 100 is shown for describing operation thereof. As described above, tightening the clamping screws 142 locks the sight pin carriers 136 in fixed positions along the dove tail track 128 preventing their movement even when the knob 132 is rotated. Conversely, as shown by the dotted lined pin carrier 136', loosening one (or more) selected clamping screw 142 unlocks the sight pin carrier 136 permitting the selected sight pin 138 to be longitudinally moved along the dove tail track 128 upon rotation of the knob 132. Therefore, if an archer desires to individually adjust only a particular one of the sight pins, he locks all the carriers 136 except the one carrying the sight pin he desires to adjust. Then, by rotating the knob 132 he may adjusted only the desired sight pin 138 while the others remain stationary. Finally, the protective bracket 146, in the preferred embodiment of the invention is a removable half-circular bracket which provides a large sighting window and effectively protects the sight pins from being damaged during use and transportation.

As it may be appreciated from the foregoing description, the structure sought to be patented may encompasses a broad range of substitutes. For example, the track defining the longitudinal movement path of the sight pins may comprise a variety of configurations such as, a concaved groove of numerous cross sectional shapes, a raised non-dove tail cross section track, a pair of parallel extending bars forming a track having a hollow slot, or in its simplest configuration the movement path or track may be defined by the rotatable threaded shaft 131 itself. All such alternatives, encompass a broad configurations or means for longitudinally moving the sight pins along the predefined path by rotating a threaded shaft. For example, the engagement means may comprise only the spring loaded ball bearing which engages the threaded shaft 131 directly without the gear 141. Commensurate with such wide variations of track substitutes and movement means, there also exist at least a corresponding number of locking means which substantially achieve the primary objective of the present invention. The present disclosure is intended to encompass any and all such variety of alternatives which fall within the scope of the present invention. The true scope of the applicant's invention may be best understood from the following claims.

I claim as my invention:

1. A bowsight, comprising:

a plurality of elongated sight pins;

track means for defining at least one path;

at least one rotatable shaft;

engagement means engaged to said rotatable shaft for longitudinally moving said sight pins along the path by rotating said shaft; and locking means for preventing movements of a selected one of said plurality of sight pins along said path even when said shaft is rotated.

2. The bow sight of claim 1, wherein said rotatable shaft comprises a threaded shaft; and wherein said movement means includes a gear for engaging said threaded shaft.

3. The bow sight of claim 2, wherein said movement means further includes a spring loaded ball bearing for engaging said gear to said threaded shaft.

4. The bow sight of claim 1, wherein said track means includes a base plate; a dove tail track disposed on said base plate; and carrier means mounted on said base plate for carrying said sight pins.

5. The bow sight of claim 4, wherein said locking means comprises a clamping means for clamping said dove tail track to said carrier means.

6. The bow sight of claim 5, wherein said clamping means includes a clamping screw which may be tightened to compresses the carrier means against the dove tail track.

7. A sight for an archery bow, comprising:

a sight block comprising:

a plurality of elongated sight pins;

a plurality of sight pin carriers for carrying said elongated sight pins;

a base plate for mounting the sight pin carriers thereon including a rotatable threaded shaft defining a path for longitudinally moving only selected ones of the sight pin carriers when the threaded shaft is rotated; each sight pin carrier including a user activatable locking means for selectively preventing longitudinal movements of the sight pin carrier when the threaded shaft is rotated; and means for mounting the sight block on the archery bow.

8. The sight of claim 7, wherein said base plate includes a dove tail track disposed along the length of said threaded shaft.

9. The sight of claim 8, wherein said locking means comprises a clamping means for clamping said sight pin carrier to said dove tail track.

10. The sight of claim 9, wherein said clamping means includes a user activated clamping screw for clamping the pin carrier to said dove tail track.

11. The sight of claim 7, wherein said sight pin carriers include a gear, and a spring loaded ball bearing for engaging to the threaded shaft.

12. A sight for an archery bow, comprising:

a sight block, comprising:

a plurality of elongated sight pins;

a plurality of sight pin carriers for carrying the elongated sight pins;

a base plate for mounting said sight pin carriers having a track defining a movement path;

a movement means including a knob for moving only selected ones of said plurality of sight pin carriers along said movement path when the knob is rotated; each of said plurality of sight pin carriers including a user activatable locking means for preventing movement of the sight pin carrier even when the knob is rotated; and means for mounting the sight block on the archery bow.

13. The sight of claim 12, wherein said track comprises a dove tail track, and wherein said locking means comprises a clamping means for clamping the sight pin carrier to said dove tail track.

14. The sight of claim 12, wherein said movement means includes a threaded shaft longitudinally positioned along the track being rotatable upon rotation of said knob, and wherein said pin carrier includes an engagement means for engaging to said shaft to permit movement of the sight pins along the track.

15. The sight of claim 14, wherein said engagement means includes, a gear, and a spring loaded ball bearing for engaging said gear against the threaded shaft.

16. The sight of claim 12 further including a protective bracket for protecting the sight pins having a half-circular shape.

* * * * *